United States Patent [19]

Bender-Zanoni et al.

[11] Patent Number: 4,982,650

[45] Date of Patent: Jan. 8, 1991

[54] MODULAR AMMUNITION PACKAGING AND FEED SYSTEM

[75] Inventors: Joseph F. Bender-Zanoni; Howard T. Cook, Jr., both of Grand Isle; Thomas W. Cozzy, Burlington, all of Vt.; Stephen A. Jarvis, Mesa, Ariz.

[73] Assignee: General Electric Company, Burlington, Vt.

[21] Appl. No.: 422,711

[22] Filed: Oct. 16, 1989

[51] Int. Cl.[5] ..... F41A 9/04

[52] U.S. Cl. ..... 89/34; 89/33.1

[58] Field of Search ..... 89/33.01, 33.1, 33.14.33.16, 89/33.17, 34

[56] References Cited

U.S. PATENT DOCUMENTS

| | | | |
|---|---|---|---|
| 1,314,013 | 8/1919 | Mulvey | 89/33.1 |
| 2,321,142 | 6/1943 | Horncastle | 89/33.14 |
| 2,910,917 | 11/1959 | Herlach et al. | 89/33.1 |
| 2,951,422 | 9/1960 | Bobkowski | 89/33.1 |
| 3,021,762 | 2/1962 | Soderqvist | 89/33.1 |
| 3,045,553 | 7/1962 | Mosle | 89/33.16 |
| 3,314,182 | 4/1967 | Harvey | 42/18 |
| 3,331,281 | 7/1967 | Jafvert | 89/33.1 |
| 3,343,456 | 9/1967 | Christiansson | 89/33.1 |
| 3,369,454 | 2/1968 | Carlsson | 89/33.05 |
| 3,656,655 | 4/1972 | Magneville et al. | 221/82 |
| 4,468,875 | 9/1984 | Harrison et al. | 89/33.16 |

*Primary Examiner*—Stephen C. Bentley

*Attorney, Agent, or Firm*—Bailin L. Kuch; Robert A. Cahill

[57] ABSTRACT

An ammunition handling system is provided with a magazine consisting of a plurality of modular, highly portable magazine packs which are readily installed in a mechanized support frame. The magazine packs contain separate ammunition conveyors commonly driven from the frame. Guides are positioned to effect direct transfers of ammunition rounds between conveyors of adjacent ammunition packs and thus to establish linear linkless ammunition round movement along a serpentine path leading to a magazine exit and ultimately to a rapid-fire gun. Rearming the gun simply involves replacing empty magazine packs with magazine packs pre-loaded with live ammunition rounds.

20 Claims, 6 Drawing Sheets

MODULAR AMMUNITION PACKAGING AND FEED SYSTEM

This invention was made with Government support under Contract No. DAAA-21-87-C-0274 awarded by the U.S. Army. The Government has certain rights in the invention.

BACKGROUND OF THE INVENTION

1. Field of the Invention

The present invention relates generally to article handling systems, and particularly to ammunition handling systems for rapid-fire guns.

2. Description of the Prior Art

Ammunition handling systems include a container or magazine in which ammunition rounds are packaged and a feeder for withdrawing rounds from the magazine for delivery to the gun on demand and in rapid succession. The ammunition is packaged in the magazine either as linked or linkless (loose) ammunition. The rounds of linked ammunition are interconnected to form an elongated belt which is drawn from the magazine to feed rounds successively to the gun. In the case of linkless ammunition, the rounds are not interconnected, and thus the magazine must be interiorly equipped with a powered conveyor for transporting the loose rounds through the magazine to an exit port. Since the conveyor must move at high velocities to satisfy the rapid-fire capabilities of modern guns, absolute and continuous control of round movement throughout the magazine interior must be maintained. To achieve this, the conveyor is equipped with round carriers uniformly distributed along its length. These carriers, with the aid of stationary magazine guide surfaces, can effectively secure the rounds to the conveyor such that they reliably follow the conveyor path through the magazine, which is typically tortuous, e.g., serpentine, to maximize packaging density.

One problem indigenous to all linear linkless ammunition feeding systems (see, e.g., U.S. Pat. No. 3,747,469 issued July 24, 1973 to E. Ashley) is reloading the magazine with live rounds of ammunition. This procedure requires that the magazine conveyor be cycled to successively present empty conveyor carriers at a magazine reloading port for acceptance of live rounds. If the resupply of live rounds is in the form of linked ammunition, reloading equipment must first unlink the rounds before delivering them to the reloading port for handoff to the magazine conveyor carriers. Typically, frequent stoppage is involved to avoid jamming due to misaligned clips or links. Thus, constant vigilance is required of skilled personnel to assure uniform reloading of the magazine conveyor with linkless ammunition rounds from a resupply of linked ammunition. This procedure is time consuming, requires special reloading equipment, and involves several, well trained technicians.

Reloading from a resupply of linkless ammunition (see, e.g., U.S. Pat. No. 3,696,704, issued Oct. 10, 1972 to L. F. Backus et al.) involves many of the same drawbacks. This approach requires a rather elaborate reloading system including a loading conveyor which must be cycled in synchronism with the magazine conveyor to withdraw live rounds from a bulk storage container and a transfer mechanism for picking rounds from the loading conveyor and handing them off to the magazine conveyor. Having such an elaborate reloading system available at a forward area rearming position presents significant logistical problems. In addition, an adequate source of power to cycle both linear linkless conveyors may not be readily available.

Aside from reloading considerations, linear linkless ammunition feeding systems require considerable maintenance. A breakdown in the field invariably requires depot service, which means that the gun system served by the feed system is out of action until repairs are effected. An additional disadvantage of linear linkless ammunition feed systems is that the magazine is of significant weight even when empty. In airborne applications, this empty weight limits the amount of alternative armament, such as rockets or missiles, and/or auxiliary fuel tanks an aircraft safety can carry.

SUMMARY OF THE INVENTION

It is accordingly an object of the present invention to provide an improved ammunition feed system.

A further object is to provide a ammunition feed system of the above-character which utilizes a modular ammunition packaging approach.

An additional object is to provide a linear linkless ammunition feed system of the above-character, wherein reloading is a simplified, inherently more reliable procedure involving minimal time and fewer, relatively unskilled personnel.

Another object is to provide a linear linkless ammunition feed system of the above-character, wherein the reloading procedure requires less logistical support in the field.

A still further object is to provide a linear linkless ammunition feed system of the above-character, which can be emptied to thus exhibit -a significantly reduced weight.

Yet another object is to provide a linear linkless ammunition feed system of the above-character, which is readily maintainable, convenient to troubleshoot and repair, and reliable in operation.

Other objects of the invention will in part be obvious and in part appear hereinafter.

In accordance present invention, there is provided an article hand system, such as an ammunition feed system, utilizing a modular packaging approach wherein ammunition rounds are accommodated in highly portable magazine packs or cassettes. Each pack includes a case equipped with a convenient carrying handle. Each case contains an endless linear linkless ammunition conveyor having a plurality of carriers distributed along its length for individually accommodating an ammunition round and an external drive element drivingly connected with the conveyor within.

The ammunition packs are separately installed in plural side-by-side load positions provided by a support frame equipped with a drive mechanism including a power takeoff site aligned with each load position. Installation of an ammunition pack in a load position automatically effects driving engagement of the pack drive element with the power takeoff site thereat. To feed ammunition to a rapid fire gun, the drive mechanism is activated to drive the magazine packs conveyors in unison. The ammunition rounds are thus routed between conveyors of adjacent magazine packs along a serpentine feed path leading to a transfer unit where they are successively handled off to an exiting gun conveyor.

To reload the feed system of the present invention, the empty ammunition packs are simply removed from their load positions and replaced with packs containing live rounds. Reloading can thus be accomplished more reliabiy and expeditiously by a minimally trained individual without activation of the drive mechanism.

The invention accordingly comprises the features construction, combination of elements and arrangement of parts, all as set forth below, and the scope of the invention will be indicated in the claims.

BRIEF DESCRIPTION OF THE DRAWING

For a full understanding of the nature of and objects of the invention reference may be had to the following Detailed Description, taken in conjunction with the accompanying drawings, in which.

Corresponding reference numerals refer to like parts throughout the several views of the drawings.

DETAILED DESCRIPTION

Figure 1:
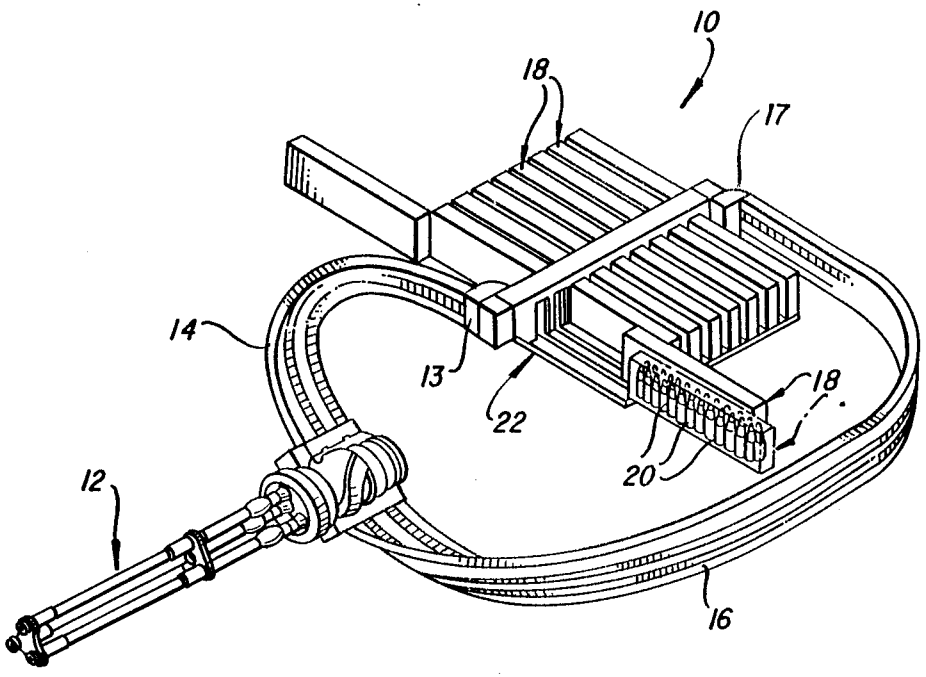
FIG. 1 is a generalized perspective view of a rapid-fire gun served by a modular ammunition packaging and feed system constructed in accordance with the present invention.

The modular ammunition packaging and feed system of the present invention, generally indicated at 10 in FIG. 1, is illustrated in its application to an armament system including a rapid-fire gun, generally indicated at 12 (see, e.g., U.S. Pat. No. 3,380,343, issued Apr. 30, 1968 to R. E. Chiabrandy et al.). Live ammunition rounds are delivered by the feed system to the gun via a transfer unit 13 and flexible chuting 14 (see, e.g. U.S. Pat. No. 3,429,221, issued Feb. 25, 1969 to R. G. Kirkpatrick) and, if desired, empty shell casings or spent rounds are delivered back to the feed system via flexible chuting 16 and a transfer unit 17 for storage. As seen generally in FIG. 1, the feed system includes, in accordance with a signal feature of the present invention, a magazine in the form of a plurality of modular magazine packs, generally indicated at 18, each including a multiplicity of ammunition rounds 20; the magazine packs being readily plugged into or installed in a mechanized frame, generally indicated at 22.

Figure 2:
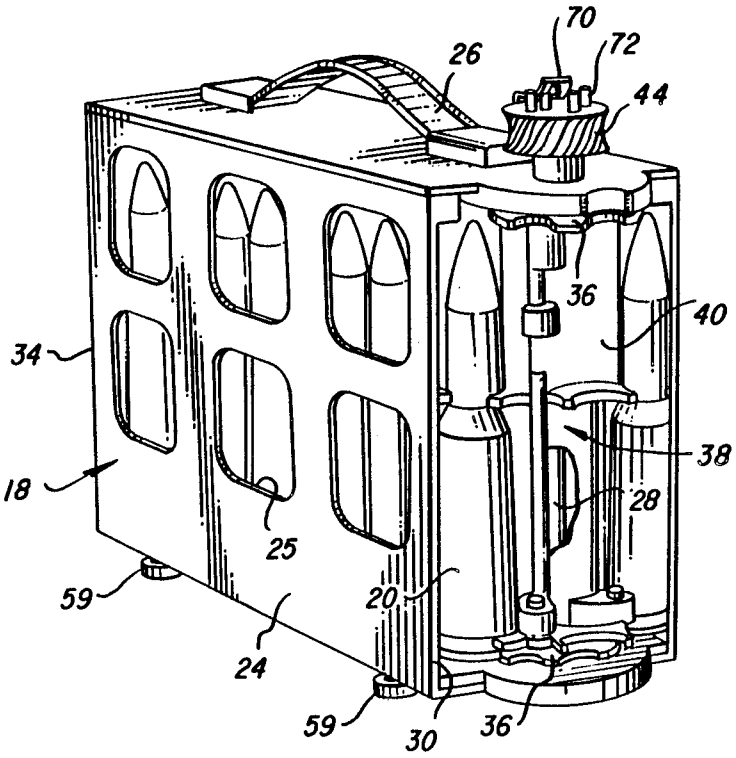
FIG. 2 is a perspective view of one of the plural modular ammunition packs utilized in the system of FIG. 1.
Figure 3:
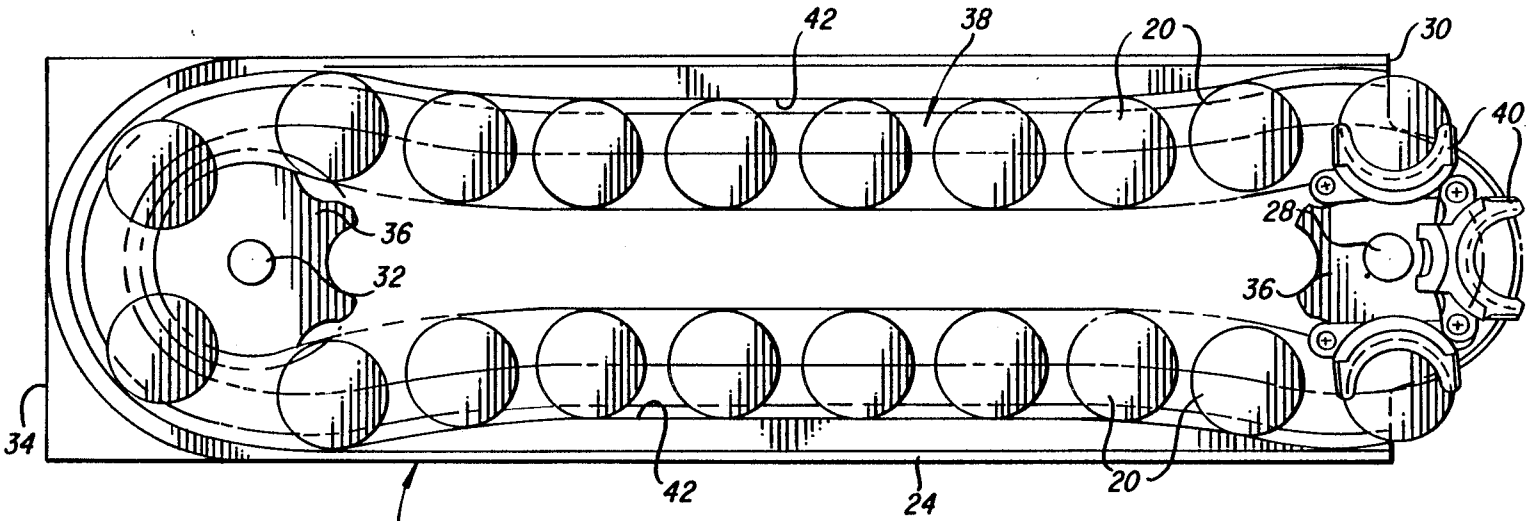
FIG. 3 is a plan view in cross section of the ammunition packs of FIG. 2.

Referring to FIGS. 2 and 3, each magazine pack 18 includes a rectangular case 24 equipped with a carrying handle 26 for convenient portability. A vertical shaft 28 is journalled by the top and bottom walls of the case adjacent an open front end 30 of the case, while a second vertical shaft 32 is journalled adjacent the opposite, closed end 34 of the case. Upper and lower sprockets 36, affixed to each vertical shaft, drivingly engage a linear linkless ammunition loop conveyor, generally indicated at 38, consisting of a series of pivotally interconnected ammunition round carriers 40. Guide surfaces 42 within case 24 maintain ammunition rounds 20 in these carriers during conveyance along a loop path through the case interior. Openings 25 in the case sidewalls serve to reduce weight and to enable observance of the presence of rounds in the case. The upper end of front shaft 28 extends through the top case wall and has fixed thereto a drive element in the form of a worm gear 44. Driven rotation of this worm gear turns sprockets 36 affixed to shaft 28 and thus propels conveyor 38 to circulate the ammunition rounds 20 in the loop path through the case interior.

Figure 4:
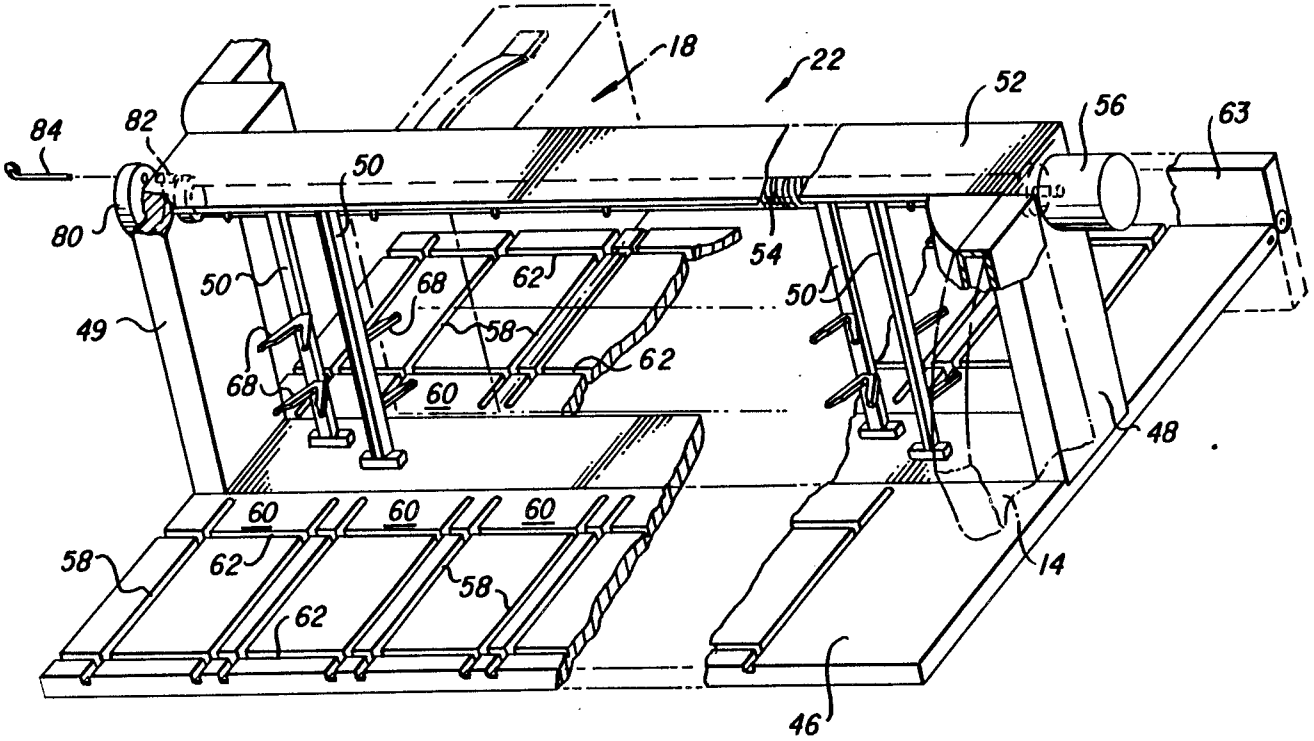
FIG. 4 is a perspective view of a mechanized support frame for the ammunition packs of FIGS. 2 and 3.

Frame 22, as seen in FIG. 4, includes a rectangular deck 46 supporting a pair of upright mounting columns 48 and 49 and a series of vertical posts 50 distributed along the longitudinal medial section of the deck between the columns. These posts are affixed at their upper ends to top plate 52 supported on the upper ends of the columns. An elongated worm 54 included in a drive mechanism is journalled adjacent its ends in columns 48, 49 and at intermediate points by bearings (not shown) depending from top plate 52. A motor 56 is drivingly connects one end of the worm. To each side of the centrally mounted, longitudinally extending worm, the upper surface of deck 46 is configured with a pattern of transversely extending pairs of grooves 58 for slidingly accepting feet 59 depending from the bottom case wall of a magazine pack 18, as seen in FIG. 2. Each pair of grooves defines a trackway for guiding a magazine pack as it is slid transversely into a load position, indicated at 60, with its worm gear 44 in meshing engagement with worm 54. Deck 46 is also provided with pairs of longitudinally extending grooves 62 intersecting the transverse grooves 58 to accommodate end loading of the magazine packs should side loading be obstructed. Gates mounted to deck 46 along its longitudinal outer edges (one seen at 63), are swung to upstanding, latched positions spanning the rear ends of the magazine packs to retain them in their respective load positions.

Figure 5:
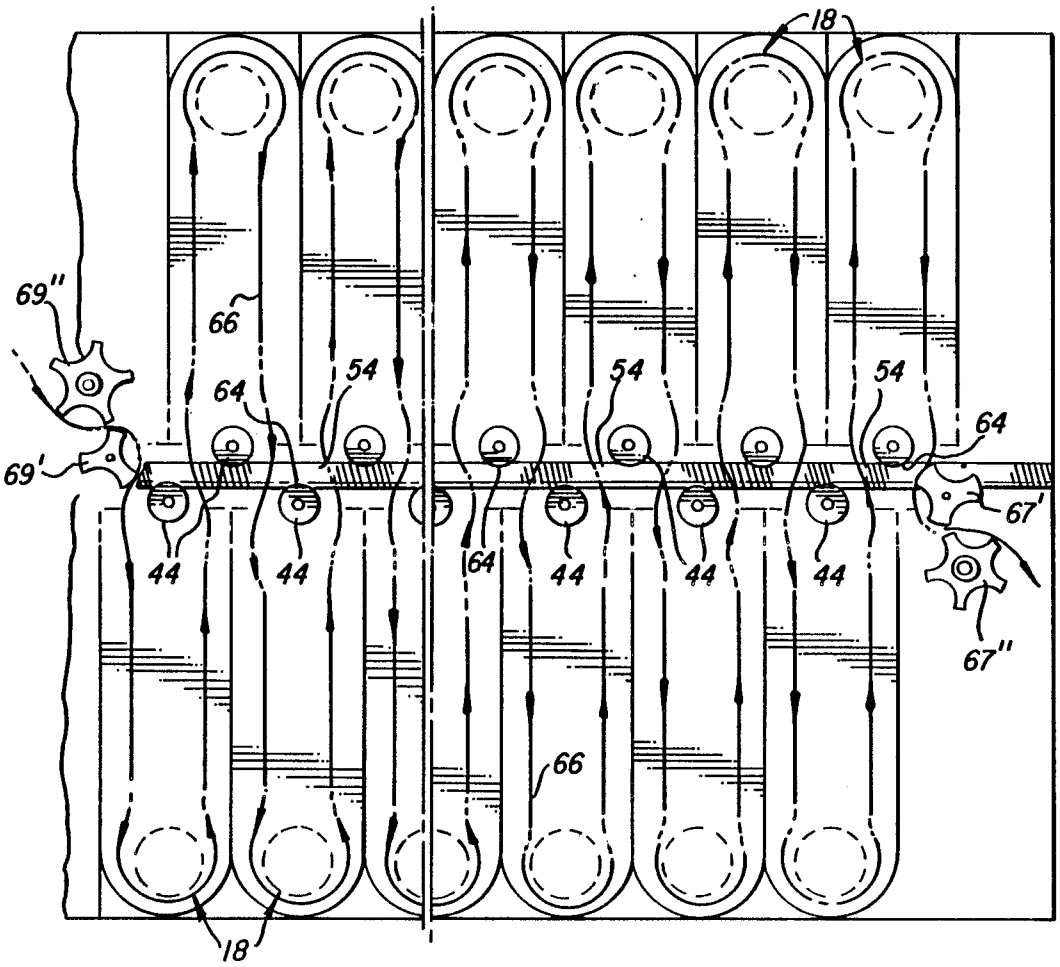
FIG. 5 is a plan view of the support frame loaded with ammunition packs and illustrates the serpentine feed path negotiated by ammunition rounds during feeding operation.

FIG. 5 illustrates in plan view opposed groups of magazine packs 18 installed in their load positions with their worm gears 44 in meshing engagement with worm 54 at power takeoff sites 64 distributed along its length. With motor 56 energized to drive worm 54, power is applied to uniformly propel the ammunition conveyors 38 (FIG. 3) in all of the magazine packs. Ammunition rounds 20 are successively transferred between conveyors of magazine packs in load positions on opposite sides of the worm in longitudinally staggered relation. There is thus achieved an overall movement of ammunition rounds 20 through feed system 10 along a serpentine path, as indicated 66, to convey successive rounds to handoff sprockets 67' and 67'' of exit transfer unit 13 (FIGS. 1 and 4) also driven by motor 56. If spent shell cases are to be saved, they arrive from the gun via flexible chuting 16 and transfer unit 17 and are handed back to the nearest magazine pack by sprockets 69' and 69'' for insertion into the serpentine feed path 66 to progressively fill the packs 18 situated there along.

Figure 6:
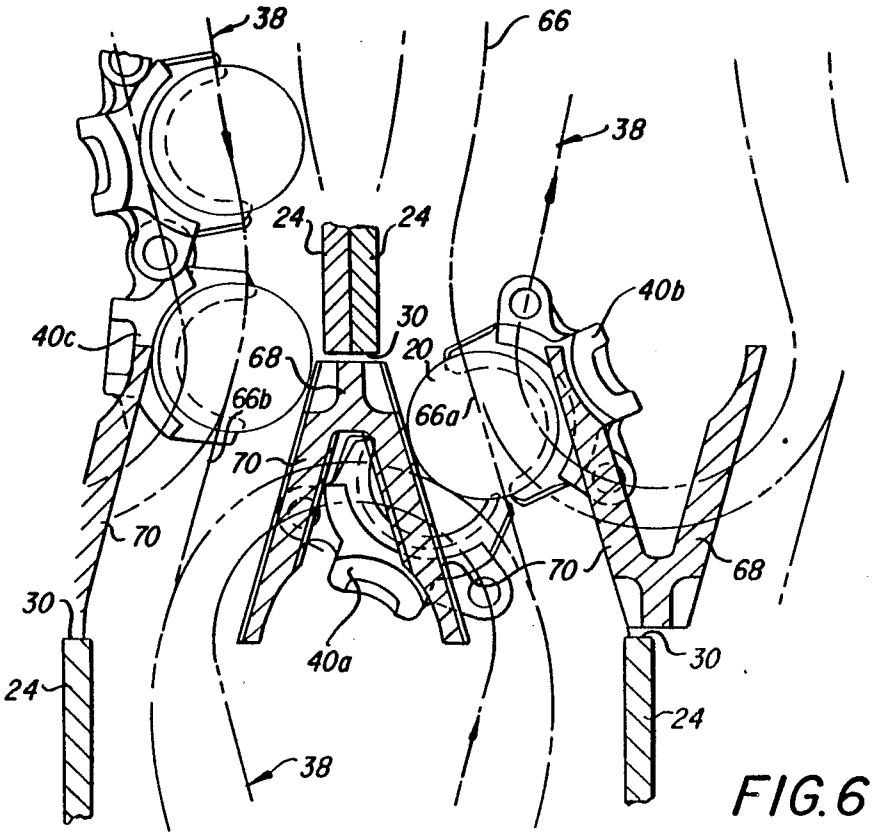
FIG. 6 is a fragmentary sectional view illustrating the transfer of ammunition rounds between magazine pack conveyors along their serpentine feed path.

These round transfers or handoffs between magazine pack conveyors are directed by pairs of V-shaped guides 68 which are mounted by each post 50 in alignment with each load position 60 as seen in FIG. 4. Thus, when magazine packs are installed in load positions 60, the divergent ends of these V-shaped guides protrude into the open front end 30 of their cases 24, as seen in FIG. 6. In this connection, it is important to note from FIGS. 2 and 3 that, to accommodate protrusion of these guides and to permit successful operation, the conveyor carrier 40 located at the open end of each magazine pack is not loaded with an ammunition round 20. Consequently, when the magazine pack conveyors 38 are driven in unison, there is always an empty carrier swinging past the open end of each magazine pack to accept the handoff of an ammunition round from an adjacently opposed magazine pack. As can be seen in FIG. 6, opposed control surfaces 70 of longitudinally adjacent guides 68 serve to guide an ammunition round 20, being conveyed in carrier **40*a* in the counter clockwise direction, out of the case open end along a transfer path 66*a*, so that the ammunition round is picked from carrier 40*a* and handed off to the conveyor carrier 40*b* of the adjacently opposed magazine pack, which carrier 40*b* is empty as it swings clockwise past the open front end of its magazine pack. The now empty carrier 40*a* swings around to accept transfer of an ammunition round from the carrier 40*c* of the other adjacently opposed magazine pack as directed by the opposed control surfaces 70 along a transfer path 66*b***.

It will be noted that round transfers from magazine pack to magazine pack are effected directly, i.e., without any intermediate handoff member. Thus, all of the carriers 40 involved in the serpentine feed path 66 are filled, and there are consequently no gaps in the flow of ammunition to the gun.

When a combat vehicle, such as an attack helicopter, returns from a mission for rearming, the empty magazine packs are simply removed from their load positions and replaced with fully loaded ammunition packs. To provide requisite coordination of the loaded ammunition pack conveyor positions and proper operation of feed system 10, all ammunition packs must be loaded with their respective one empty conveyor carrier in the same relative position, i.e. the front center position in the open end of their pack cases. To this end, each magazine pack is provided with synchronizing provisions, which in the illustrated embodiment of FIGS. 2, 7 and 8, take the form of a spring 70 mounted on case 24 and having a slotted free end for engaging a pin 72 upstanding from the upper surface of worm gear 44. The position of pin 72 is coordinated with the front center position of a carrier 40 at the open end 30 of the magazine case 24. Thus, if all of the carriers are loaded with an ammunition round except one, and conveyors 38 are all positioned with their one empty carrier at the requisite front center position latched by engagement of spring 70 with pin 72, then all the conveyors are in corresponding, coordinated positions. If a quarter turn of worm gear 44 positions successive carriers at this front center position, then four upstanding pins 72 may be provided at positions 90° apart.

Figure 8:
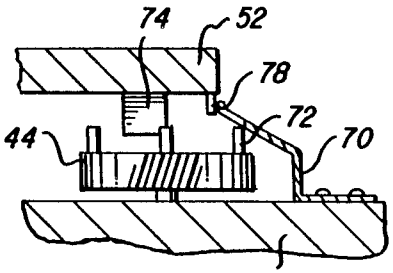
FIG. 8 is a sectional view taken along line 8—8 of FIG. 7.
Figure 7:
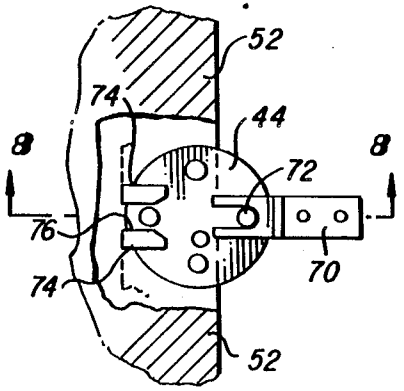
FIG. 7 is a fragmentary plan view of structure for ensuring coordinated loading of ammunition packs.

As seen in FIGS. 7 and 8, this arrangement affords convenient means for guiding the magazine packs into their final load positions with worm gears 44 smoothly slipping into meshing engagement with worm 54. To this end, at each load position 60 (FIG. 4) the underside of frame top plate 52 carries a pair of longitudinally spaced guides 74 defining therebetween a narrow entryway 76 through which the foremost worm gear pin 72, diametrically opposed to the pin latched by spring 70, passes as the magazine pack is slid into its ultimate load position. This foremost pin clears entryway 76 as worm gear 44 slips into meshing engagement with worm 54 at one of the power takeoff sites 64 (FIG. 5) and as the free end of spring 70 is deflected upward by a latch release pin 78 depending from plate 52. The spring is then disengaged from pin 72 and guides 74 assumes positions inside the circle swung by the pins during worm gear rotation. The worm gear is thus free to rotate when driven by the worm.

It remains to ensure that worm 54 is in an appropriate reference angular position during loading such that the magazine pack worm gears can freely slip into coordinated meshing engagement therewith. This is achieved in the illustrated embodiment by providing a disk 80 keyed to the end of the worm extending beyond column 49, as seen in FIG. 4. The worm is indexed by motor 56 until reference holes in the disk and column, commonly indicated at 82, are in alignment to accept a pin 84 for retaining the worm in a coordinated angular loading position.

From the foregoing description, it is seen that the modular ammunition and feed system of the present invention accommodates a reload procedure which is both simple and fast. Empty or spent round filled magazine packs are simply removed and replaced with magazine packs filled with live rounds. It has been determined that one person can completely reload a complement of twenty four magazine packs in less than ten minutes. Logistical support is reduced to simply making preloaded magazine packs available at the rearming site. The loading of magazine packs does not consume power, since their conveyors are not cycled. This being the case, jams can not happen.

It will also be appreciated that the present invention dramatically improves reliability. Over 90% of the moving, wearing parts in the system are in the magazine packs which are constantly being replaced. This, in effect, provides an automatic and continuous maintenance program. In the same manner, maintenance in the field is simplified. A feed malfunction would almost invariably involve a breakdown in one of the magazine packs, which is readily remedied by replacing it with another pack. Also to be noted is that a significant portion of the weight of the system of the present invention is represented by the magazine packs. Thus, with all or some of the magazine packs removed, the system weight is reduced. This is an important feature in airborne applications, enabling the aircraft to safely carry reconfigured armament arrays, such as additional rockets and/or missiles, and/or auxiliary fuel tanks for extended range.

It is seen from the foregoing that the objects set forth above, including those made apparent from the preceding description, are efficiently attained, and, since certain changes may be made in the disclosed embodiment without departing from the scope of the invention, it is intended that all matters of detail be taken as illustrative and not in a limiting sense.

Having described the invention, what is claimed as new and desired to secure by Letter Patent is:

1. An article handling system comprising, in combination:

A. a support frame having
  (1) a plurality of side-by-side load positions, and
  (2) a drive mechanism including a separate power takeoff site aligned with each said load position;

B. a separate cassette removably positioned at each said load position, each said cassette including
  (1) a case,
  (2) an endless loop conveyor mounted within said case and having a plurality of carriers distributed along the conveyor length for individually accommodating an article for conveyance, and (3) a drive element drivingly connected with said conveyor and drivingly connectable with one of said power takeoff sites;

C. an exit conveyor positioned adjacent one of said load positions for accepting consecutive articles conveyed thereto from said cassette positioned at said one load position; and D. guide means positioned to route the articles from cassette conveyor to cassette conveyor along a serpentine path leading to said exit conveyor when said drive elements are commonly driven by said drive mechanism.

2. The article handling system defined in claim 1, wherein said load positions are arranged to locate said cassettes in first and second groups of side-by-side cassettes in opposed, confronting relation with said drive mechanism, said guide means routing the articles directly between said conveyors of adjacently confronting cassettes of said first and second groups.

3. The article handling system defined in claim 2, wherein said drive mechanism includes an elongated worm centrally located relative to said first and second groups of cassettes, and said cassette drive elements are worm gears meshing with said worm at said power takeoff sites distributed along the length thereof.

4. A modular ammunition packaging and feed system for a rapid-fire gun comprising, in combination:

A. a support frame having (1) a plurality of side-by-side load positions, and (2) a drive mechanism including a separate power takeoff site aligned with each said load position;

B. a magazine having an exit and including a plurality of modular magazine packs, each said magazine pack having (1) a case, (2) an endless loop conveyor mounted within said case and having a plurality of carriers distributed along the conveyor length for individually accommodating a round of ammunition for conveyance, and (3) a drive element drivingly connected with said loop conveyor and driving connectable with said drive mechanism at said power takeoff site aligned with one of said load positions in which said magazine pack is disposed; and C. guide means positioned to transfer ammunition rounds between said loop conveyors of adjacent said magazine packs along a serpentine path ending at said magazine exit when said drive elements are driven in unison by said drive mechanism.

5. The modular ammunition packaging and feed system defined claim 4, wherein said load positions are arranged to locate said magazine packs in first and second groups of side-by-side magazine packs in opposed, confronting relation with said drive mechanism, said guide means routing the ammunition rounds directly between said loop conveyors of adjacently confronting magazine packs of said first and second groups.

6. The modular ammunition packaging and feed system defined in claim 5, wherein said drive mechanism includes a motor driving an elongated worm centrally located relative to said first and second groups of magazine packs, and said magazine pack drive elements are worm gears meshing with said worm at said power takeoff sites distributed along the length thereof.

7. The modular ammunition packaging and feed system defined in claim 5, wherein said guide means are mounted by said frame.

8. The modular ammunition packaging and feed system defined in claim 5, wherein each said pack further includes feet depending from said case, and said frame includes a deck for supporting said ammunition packs, said deck having patterns of surface grooves in which said feet are received to guide the loading motions of said ammunition packs into said load positions.

9. The modular ammunition packaging and feed system defined in claim 5, wherein each said magazine pack includes a carrying handle.

10. The modular ammunition packaging and feed system defined in claim 5, wherein each said magazine pack includes means for coordinating the positions of said loop conveyors prior to the loading of said magazine packs in said load positions.

11. The modular ammunition packaging and feed system defined in claim 10, wherein said coordinating means includes a latch for releaseably retaining said loop conveyor in a position to present an empty one of said carriers in predetermined relation with said guide means upon loading said magazine packs into said load positions.

12. The modular ammunition packaging and feed system defined in claim 11, wherein said frame further includes means at each said load position for controlling the loading motions of said ammunition packs into said load positions.

13. The modular ammunition packaging and feed system defined in claim 12, wherein said frame further includes a deck for supporting said magazine packs in said load positions, said controlling means includes surface formations on said deck for guiding the loading motions of said ammunition packs.

14. The modular ammunition packaging and feed system defined in claim 13, wherein said frame further includes latch release elements positioned to engage said latches and unlatch said loop conveyors incident to said magazine packs assuming said load positions.

15. The modular ammunition packaging and feed system defined in claim 14, wherein said drive mechanism includes a motor driving an elongated worm centrally located relative to said first and second groups of magazine packs, and said magazine pack drive elements are worm gears meshing with said worm at said power takeoff sites distributed along the length thereof.

16. The modular ammunition packaging and feed system defined in claim 15, wherein said controlling means further includes interactive control elements carried by said frame and said worm gears for guiding said worm gears into meshing engagement with said worm at said power takeoff sites as said magazine packs assume said load positions.

17. The modular ammunition packaging and feed system defined in claim 16, wherein said frame further includes means for establishing a reference angular position for said worm accommodating meshing engagement of said worm gears therewith during loading of said magazine packs.

18. The modular ammunition packaging and feed system defined in claim 5, wherein said loop conveyor of each said magazine pack is trained around front and rear turnaround sprocket sets, said front sprocket set disposed adjacent an open front end of said case, said guide means including guide elements protruding into said case open front ends in positions to divert ammunition rounds from said carriers arriving at said case open ends and route the diverted ammunition rounds directly into empty said carriers of adjacently opposed magazine packs prior to leaving said case open front ends.

19. The modular ammunition packaging and feed system defined in claim 18, which further includes a transfer unit at said magazine exit for accepting successive ammunition rounds arriving at said serpentine ending for delivery to the rapid-fire gun.

20. The modular ammunition packaging and feed system defined in claim 19, wherein said magazine further includes an entry, said system further including an additional transfer unit at said entry for introducing successive spent ammunition rounds returned from the rapid-fire gun into the beginning of said serpentine path.

* * * * *